United States Patent [19]

Okano

[11] Patent Number: 4,864,183

[45] Date of Patent: Sep. 5, 1989

[54] ELECTRIC LAMP ASSEMBLY HAVING IMPROVED MECHANICAL CONNECTION BETWEEN LIGHT BULB AND MOLDED PLASTIC HOLDER BODY

[75] Inventor: Mitsuhiro Okano, Shizuoka, Japan

[73] Assignee: Koito Seisakusho Co., Ltd., Tokyo, Japan

[21] Appl. No.: 232,902

[22] Filed: Aug. 15, 1988

[30] Foreign Application Priority Data

Mar. 24, 1988 [JP] Japan ..... 63-70627

[51] Int. Cl.[4] ..... H01J 5/14; F21M 3/30

[52] U.S. Cl. ..... 313/318; 362/296; 313/51

[58] Field of Search ..... 313/318, 579, 113, 50, 313/51; 362/226, 267, 211, 296, 308, 310, 368, 375; 439/36, 220, 222

[56] References Cited

U.S. PATENT DOCUMENTS

| | | | |
|---|---|---|---|
| 3,885,149 | 5/1975 | Wolfe et al. | 313/318 X |
| 4,500,946 | 2/1985 | Mikola | 362/226 |
| 4,547,838 | 10/1985 | Wakimizu | 313/318 X |
| 4,634,920 | 1/1987 | Rijckaert et al. | 313/318 |
| 4,641,056 | 2/1987 | Sanders et al. | 313/51 |
| 4,769,574 | 9/1988 | Nagasawa et al. | 313/318 |

*Primary Examiner*—Kenneth Wieder

*Attorney, Agent, or Firm*—Browdy and Neimark

[57] ABSTRACT

A lamp assembly having a molded plastic holder body for holding a light bulb in position thereon. The light bulb has a flat base encircled by a holder band which has bulb retainer lugs resiliently engaging the bulb base under their own bias. The holder band inclusive of the bulb retainer lugs is made from a metal (e.g. nickel silver) that is resilient enough to enable the lugs to securely engage the bulb base. Spot welded to the holder band is a first connector made from another metal (e.g. austenitic stainless steels of certain specific compositions) that is weldable enough to permit the first connector to be firmly welded to the holder band. A second connector of substantially tubular shape, which may be made from the same metal as the first connector, is immovably engaged in the holder body and welded to the first connector. Thus the light bulb is securely engaged by the holder band of resilient metal and firmly mechanically coupled to the molded plastic holder body via the first and second connectors of weldable metal.

14 Claims, 13 Drawing Sheets

ELECTRIC LAMP ASSEMBLY HAVING IMPROVED MECHANICAL CONNECTION BETWEEN LIGHT BULB AND MOLDED PLASTIC HOLDER BODY

BACKGROUND OF THE INVENTION

My invention relates to lighting devices, to electric lamps, and to a lamp assembly comprising a light bulb and a bulb holder assembly for vehicular headlight and like applications. More specifically, my invention deals with such a lamp assembly featuring improved provisions for mounting a light bulb such as a halogen cycle incandescent lamp in place on a holder body of plastics material.

In an incandescent lamp assembly for vehicular headlight applications, it has been known to hold the light bulb by a molded plastic holder body of substantially tubular shape in order to be mounted to a reflector. The holder body is molded from a plastic by reasons of dimensional accurary obtainable and the close contact that can be realized between the holder body and the reflector by virtue of the pliancy of the plastic. Special consideration is needed in holding the light bulb of vitreous material by the plastic holder body. Conventionally, for this purpose, a metal made holder band has been wrapped around the pinch sealed base of the light bulb for resiliently engaging the bulb base by opposed pairs of bulb retainer lugs formed in one piece with the holder band. This holder band has been plasma welded to a metal made connector of tubular shape immovably engaged in the plastic holder body. It is thus seen that the light bulb has so far been supported by the plastic holder body via two metal made members, that is, the holder band and the connector.

A problem has heretofore been encountered in the choice of materials for the two metal made members through which the light bulb is coupled to the plastic holder body. The holder band, one of the two members in question, must resiliently engage the bulb base via the self biased retainer lugs formed integral therewith. High resiliency is therefore the first and foremost requirement of the material for the holder band. As far as resiliency is concerned, nickel silver is the most desirable material I know of the holder band. However, fabricated from nickel silver, the holder band cannot possibly be firmly joined to the connector by plasma welding even if the connector is of weldable material.

Austenitic stainless steels of certain specific compositions are better suited for plasma welding. When made from this type of material, the holder band would be positively welded to the connector but would lack in resiliency. The holder band would then be unable to securely hold the light bulb and, in the worst case, might crack or otherwise destroy the bulb base.

SUMMARY OF THE INVENTION

I have hereby invented, in an electric lamp assembly of the type defined, how to firmly hold a light bulb of vitreous material by a holder body of plastic material without the above discussed difficulties encountered heretofore.

Briefly, my invention may be summarized as an electric lamp assembly for vehicular headlight and other lighting applications, comprising a light bulb, and a holder band holding the light bulb by resiliently engaging its base, the holder band being made from a first metal that is resilient enough to enable the holder band to firmly hold the light bulb. Welded to the holder band, as by spot welding, is a first connector which is made from a second metal that is weldable enough to permit the first connector to be firmly welded to the holder band. A second connector of weldable material is immovably engaged in a molded plastic holder body of substantially tubular shape and is welded to the first connector. Thus the light bulb is held in place on the plastic holder body via the holder band and the first and second connectors.

I particularly recommend nickel silver as a material of the holder band. Made from nickel silver, the holder band can firmly hold the base of the light bulb as by opposed pairs of bulb retainer lugs which are formed integral with the holder band and which are self biased into resilient engagement with the bulb base. The high resiliency of nickel silver serves the additional purpose of precluding the possibility of cracking or otherwise ruining the bulb base by the bulb retainer lugs during assemblage or use of the lamp assembly. Good heat conduction is another reason why I recommend nickel silver. The holder band will favorably take up and radiate the heat generated by the light bulb in the use of the lamp assembly.

A recommended material of both first and second connectors is stainless steel, particularly austenitic steels of certain specific compositions to be set forth later in this disclosure. The first connector of stainless steel can be relatively easily joined to the nickel silver holder band as by spot welding. Of course, being both of stainless steel, the first and second connectors can be positively plasma welded to each other. Experiment has proved that my invention drastically reduces the percentage of poor mechanical connections between vitreous light bulb and plastic holder body.

The above and other features and advantages of my invention and the manner of realizing them will become more apparent, and the invention itself will best be understood, from a study of the following description and appended claims, with reference had to the attached drawings showing some preferable embodiments of my invention.

DESCRIPTION OF THE PREFERRED EMBODIMENTS

Figure 1:
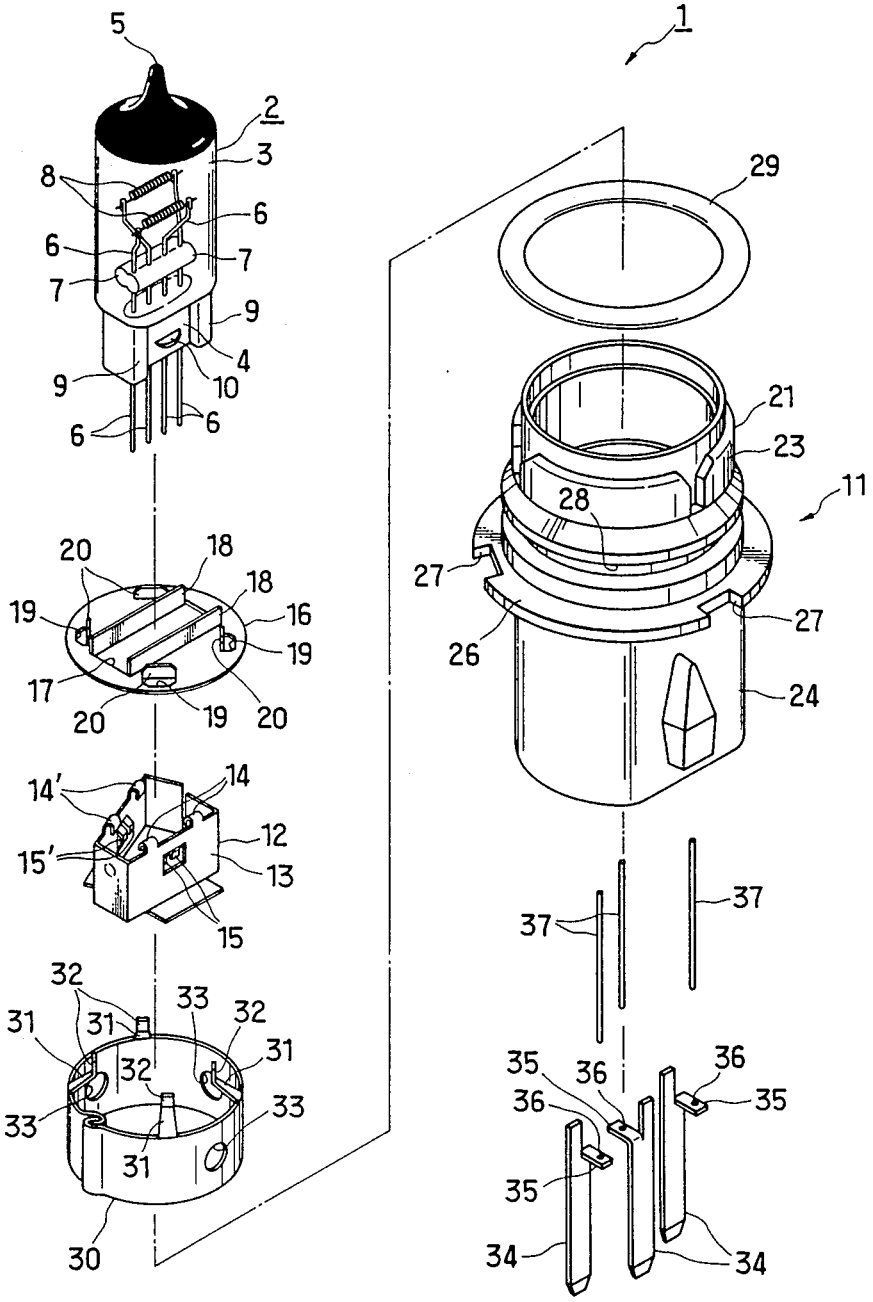
FIG. 1 is an exploded perspective view of a halogen cycle incandescent lamp assembly embodying the novel concepts of my invention.
Figure 2:
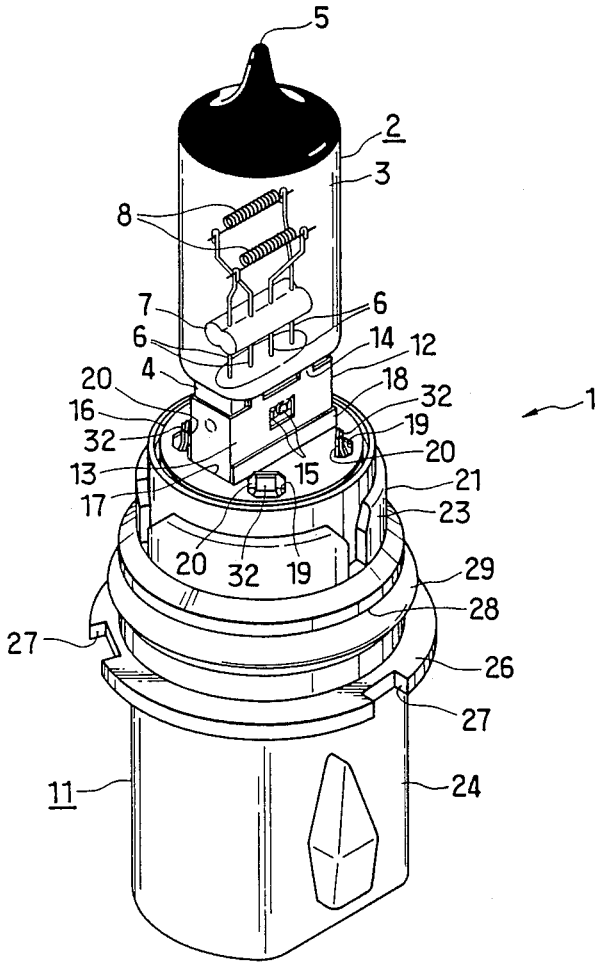
FIG. 2 is a perspective view of the lamp assembly of FIG. 1 in assembled form.
Figure 3:
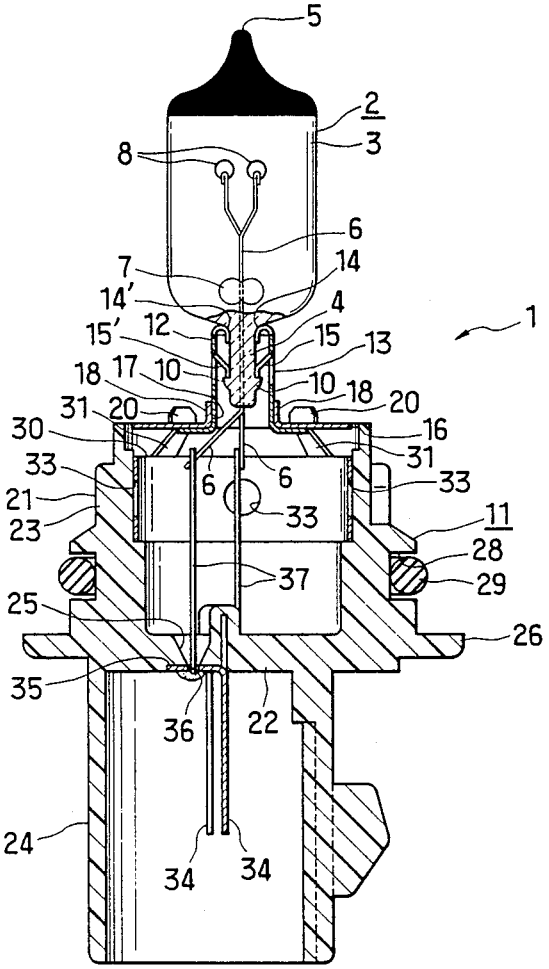
FIG. 3 is an axial section through the lamp assembly of FIG. 2.

I will now describe my invention in detail as embodied in the halogen cycle incandescent lamp assembly, generally designated 1 in FIGS. 1–3, for vehicular headlight applications. The lamp assembly 1 includes a dual filament light bulb 2 having a vitreous envelope 3 of suitable high temperature material. This envelope 3 has a flat base 4 formed by pinch sealing its open end, and an exhaust tip 5 at the other end. Having its opposite ends hermetically closed, the envelope 3 contains a measured amount of a halogen together with a suitable inert fill gas at a suitable fill pressure.

At 6 are shown two pairs of leads extending through the base 4 of the bulb envelope 3. Within the bulb envelope 3 a vitreous bridge 7 retains the two pairs of leads 6 in prescribed positions of alignment and thus enables the same to maintain two coiled filaments 8 in preassigned spaced apart position, each filament being connected between the tips of one pair of leads 6. The leads 6 have portions projecting downwardly or rearwardly from the bulb base 4.

As will be best understood from FIG. 1, the base 4 of the bulb envelope 3 is of I shaped cross section, including a pair of relatively enlarged side flanges 9. Both FIGS. 1 and 3 indicate that the web portion of the bulb base 4 has a pair of small ledges 10 formed approximately centrally on its opposite sides. The ledges 10 are integral parts of the bulb base 4.

The reference numeral 11 in FIGS. 1–3 generally indicates a bulb holder assembly for firmly holding the light bulb 2. Broadly, as best illustrated in FIG. 1, the bulb holder assembly 11 comprises a metal made holder band 12 encircling the bulb base 4 and positively engaged therewith, a first metal made connector 16 in the shape of a disc to be rigidly coupled to the holder band 12, a substantially tubular holder body 21 of rigid plastic material to be mounted to a vehicular headlight housing, not shown, and a second metal made connector 30 of tubular shape for rigidly connecting the holder band 12 to the holder body 21 via the first metal made connector 16. I will describe in detail these principal components 12, 16, 21 and 30 of the bulb holder assembly 11 successively hereafter.

Figure 4:
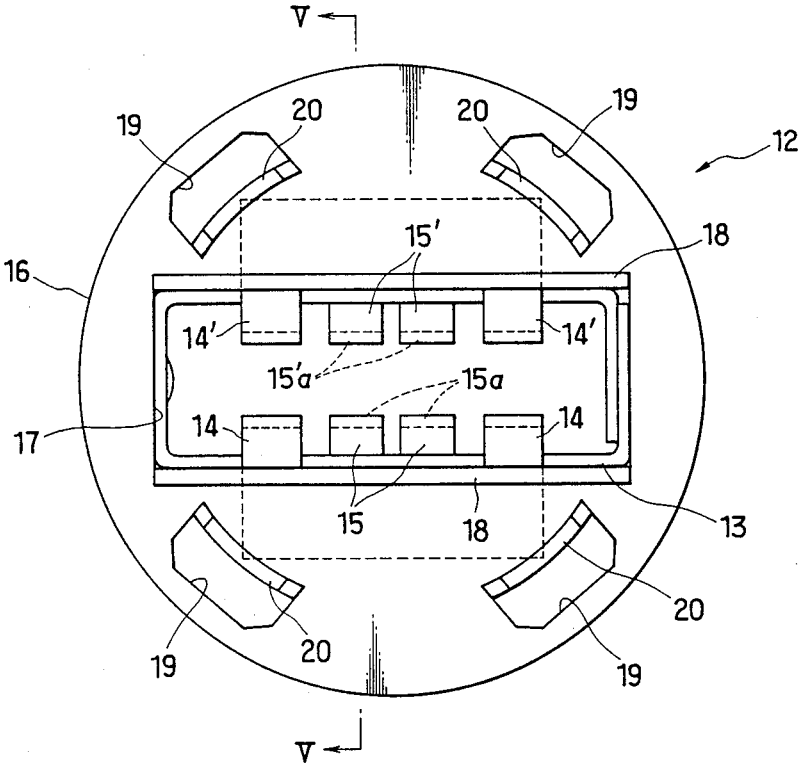
FIG. 4 is an enlarged plan view of the holder band and the first connector, both included in the lamp assembly of FIG. 2 and shown coupled to each other in their proper relative positions.
Figure 5:
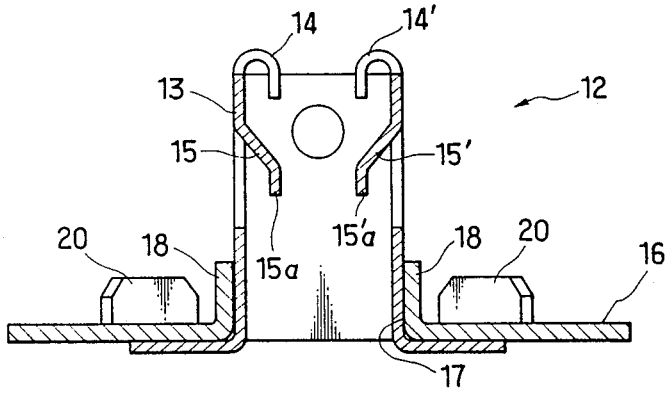
FIG. 5 is a section through the holder band the first connector, taken along the line V—V in FIG. 4.

Although the holder band 12 appears in all of FIGS. 1–3, I have illustrated it on an enlarged scale in FIGS. 4 and 5 in combination with the first metal made connector 16. The holder band 12 has a generally tubular or boxlike portion 13, open at opposite ends, to be fitted over the bulb base 4. The tubular portion 13 has two pairs of resilient U shaped bulb retainer lugs 14 and 14' extending forwardly from its opposite pair of longer sides so as to butt against the opposite sides of the web portion of the bulb base 4. Each pair of bulb retainer lugs 14 or 14' are so dimensioned, and so spaced from each other, as to fit closely between the pair of flanges 9 of the bulb base 4.

The tubular portion 13 of the holder band 12 is further formed to include two other pairs of bulb retainer lugs 15 and 15' formed approximately centrally in its opposite pair of broader sides and extending generally inwardly and rearwardly to terminate in tips 15*a* and 15'*a* laid approximately parallel to the surfaces of the bulb base 4. These tips 15*a* and 15'*a* of the bulb retainer lugs 15 and 15' are to make positive engagement with the pair of ledges 10 on the opposite sides of the bulb base 4.

In the holder band 12 of the above described construction, both the two front pairs of bulb retainer lugs 14 and 14' and the two rear pairs of bulb retainer lugs 15 and 15' must be resiliently held against the flat base 4 of the light bulb 2 under their own bias in order to firmly hold the light bulb.

Therefore, I recommend nickel silver as a material of the holder band 12 for its high resiliency, as well as for its good heat conduction. Nickel silver, as is well known, is a nonferrous alloy of nickel, copper and zinc having a silver appearance. Particularly preferred compositions of nickel silver for the purposes of my invention are about 61–67% copper, 16.5–19.5% nickel, up to 0.1% lead, up to 0.25% iron, up to 0.5% manganese, and the remaining percentage zinc. Brass, a copper zinc alloy, is another example of material that may be employed for the fabrication of the holder band meeting the requirements of my invention.

Generally disclike in shape, the first metal made connector 16 has an opening 17 of rectangular shape defined centrally therein. This opening 17 is shaped and sized to relatively closely receive the tubular portion 13 of the holder band 12. A pair of support walls 18 extend forwardly and right angularly from the pair of opposite longer edges bounding the opening 17.

As best pictured in FIG. 5, the holder band 12 is inserted in the opening 17 in the first connector 16 until a pair of flanges on its rear end come into contact with the connector. The pair of support walls 18 are secured to the pair of broader walls of the tubular portion 13 as by spot welding, particularly plasma welding. Thus the holder band 12 and the first connector 16 are rigidly joined to each other in the state of FIG. 5.

FIG. 4 best reveals a plurality of, four in this embodiment, apertures 19 formed in the first connector 16 at circumferential spacings therein by punching. As many connector lugs 20 are formed one adjacent each aperture 18 by forwardly bending the punched parts of the first connector 16.

High resiliency is not an essential attribute of the material of the first connector 16. Rather, the first connector must be easily and securely weldable to the holder band 12 as well as to the second metal made connector 30. I suggest stainless steel as a material of the first connector 16 for its good weldability. Stainless steel containing both chromium and nickel, in addition to iron, will serve the intended purposes better than other types of stainless steels. Currently preferred compositions are 18–20% chromium, 8–10.5% nickel, up to 0.08% carbon, up to 1.0% silicon, up to 2.0% manganese, up to 0.045% phosphorus, up to 0.03% sulfur, and the remaining percentage iron.

As will be understood from FIGS. 2 and 3, the light bulb 2 is held by the holder band 12 by having its bulb base 4 forced into the tubular portion 13 of the holder band. Upon full insertion of the bulb base 4 in the holder band 12, the two pairs of bulb retainer lugs 14 and 14' are pressed against the opposite sides of the web portion of the bulb base 4 and the against the base end of the bulb envelope 3. Further the other two pairs of retainer lugs 15 and 15' on the holder band 12 make locking engagement the ledges 10 of the bulb base 4. It is thus seen that the holder band 12 positively holds the light bulb 2 against the possibility of any accidental detachment or displacement.

Preferably molded from a thermoplastic synthetic resin, the substantially tubular holder body 21 has a partition 22, FIG. 3, forming a boundary between a front body portion 23 and a rear body portion 24. The front body portion 23 functions primarily for supporting the light bulb 2 whereas the rear body portion 24 serves as a connector for the light bulb. The holder body 21 has a flange 26 approximately in the middle of its longitudinal dimension. The flange 26 has a plurality of, three in this embodiment but only two seen in FIGS. 1 and 2, recesses 27 formed in preassigned angular positions thereon for use in mounting the lamp assembly 1 to the unshown lamp housing in the correct angular position about the lamp axis.

Formed in the outer surface of the body 21, in a position spaced forwardly from the flange 26, is an annular groove 28 in which there is fitted an O ring seal 29. This seal serves to watertightly sealing the joint between the lamp assembly 1 and the unshown lamp housing.

As shown also in FIGS. 1–3, the second metal made connector 30 is shaped and sized to fit closely in the front portion 23 of the holder body 21 and serves to mechanically connect the light bulb 2 to the holder body 21. Being intended to be welded to the first connector 16, the second connector 30 should also be fabricated from a weldable metal such as stainless steel. Thus, in practice, the second connector 30 can be made of the same material as the first connector 16. As will be noted from FIG. 1, the second connector 30 can be formed by winding a strip or band of stainless steel sheet into tubular form and by clinching the meeting ends of the strip.

Extending forwardly and inwardly from the front end of the second connector 30 are a plurality of, four in this embodiment, connector fingers 31 having tips 32 received in the respective apertures 19 in the first metal made connector 16. A suitable number (e.g. three) of holes 33 are formed in the second connector 30 at circumferential spacings for a purpose set forth in the following.

After mounting the second connector 30 in the front portion 23 of the holder body 21 as seen in FIGS. 2 and 3, the holder body may be heated as by high frequency induction heating. Being thermoplastic, the holder body 21 will then melt and partly flow into the holes 33 in the second connector 30 thereby locking the same in position within the holder body.

At 34 in FIGS. 1 and 2 are seen three bladelike terminals mounted within the rear portion 24 of the holder body 21. Each terminal 34 has a mounting lug 35 bent right angularly therefrom. Each mounting lug 35 has a hole 36. The mounting lugs 35 and adjacent parts of the terminals 34 are embedded in the partition 22 of the holder body 21, in such positions thereon that the holes 36 in the mounting lugs 35 are aligned with respective tapered holes 25 in the partition. Extending through the holes 25 in the partition 22, wires or conductors 37 are received each at one end in the holes 36 and soldered to the mounting lugs 35.

I have already described how the first connector 16 is attached to the holder band 12, how this holder band is mounted to the base 4 of the light bulb 2, and how the second connector 30 is mounted within the front portion 23 of the holder body 21. The following, then, is a discussion of how the subassembly of the light bulb 2, holder band 12 and first connector 16 is connected to the subassembly of the holder body 21 and second connector 30.

Toward this end the tips 32 of the fingers 31 on the second connector 30 may first be inserted in the respective apertures 19 in the first connector 16. I understand that the apertures 19 are large enough to receive the finger tips 32 with such clearances as to permit the rotation of the holder body 21 relative to the light bulb 2 within limits. Thus the light bulb 2 and the holder body 21 may be manually turned relative to each other until the bulb filaments 8 become correctly positioned with respect to the positioning recesses 27 in the holder body flange 26. Then the finger tips 32 of the second connector 30 may be plasma welded to the lugs 20 on the first connector 16. The two connectors 16 and 30 will be firmly welded together as they are both made of stainless steel. Now the light bulb 2 has been securely mounted to the holder body 21 via the holder band 12 and first 16 and second 30 connectors.

The leads 6 extending outwardly from the bulb base 4 may be conventionally joined to the conductors 37 as by soldering. I recommend soldering by high frequency induction heating.

Second Form

Figure 6:
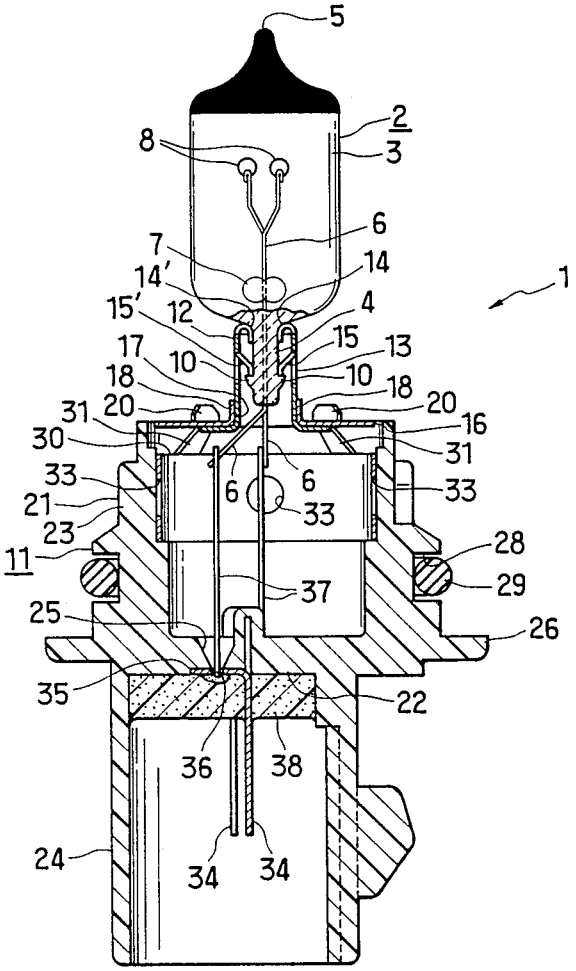
FIG. 6 is a view similar to FIG. 3 but showing a slight modification of the FIGS. 1–5 embodiment.

FIG. 6 illustrates a slight modification of the FIGS. 1–5 embodiment. The modified lamp assembly features a layer 38 of an adhesive material which is formed in the rear portion 24 of the holder body 21 by charging the adhesive material therein after soldering the conductors 37 to the mounting lugs 35 of the blade-like terminals 34. The adhesive layer 38 is intended to improve the waterproofness of the lamp assembly 1 and to firmly maintain the terminals 34 in position within the holder body 21.

Third Form

Figure 7:
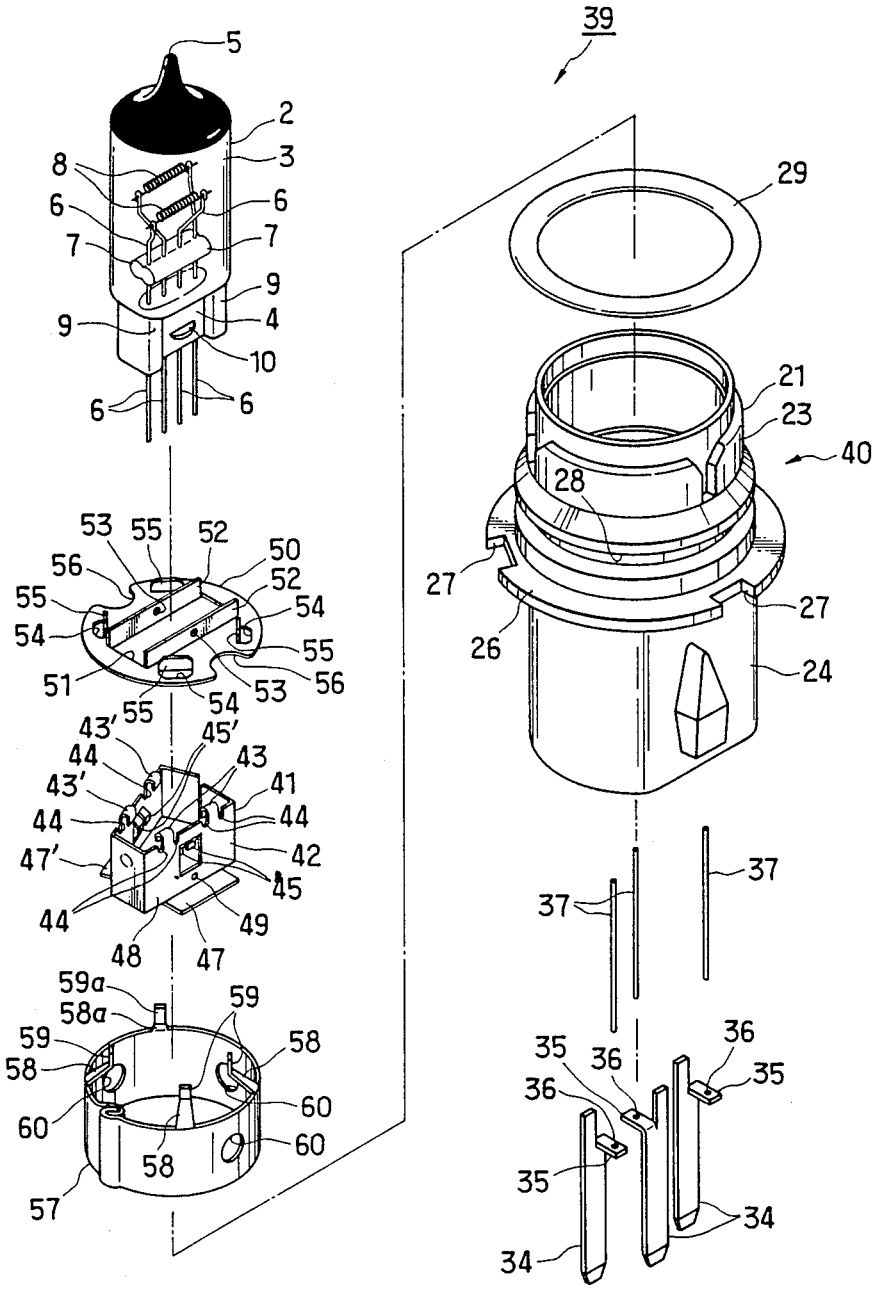
FIG. 7 is an exploded perspective view of another halogen cycle incandesent lamp assembly constructed in accordance with the principles of my invention.
Figure 8:
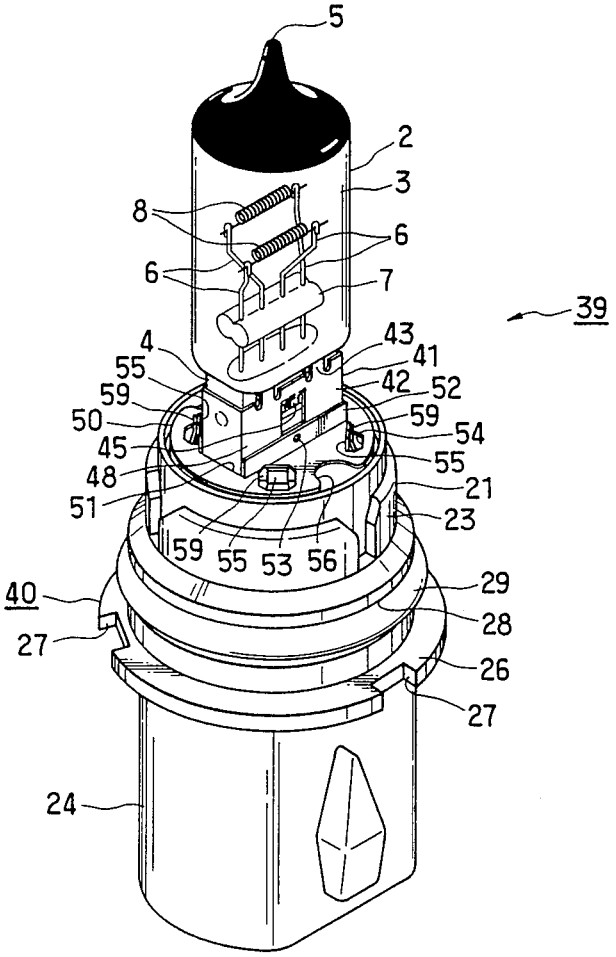
FIG. 8 is a perspective view of the lamp assembly of FIG. 7 in assembled form.
Figure 9:
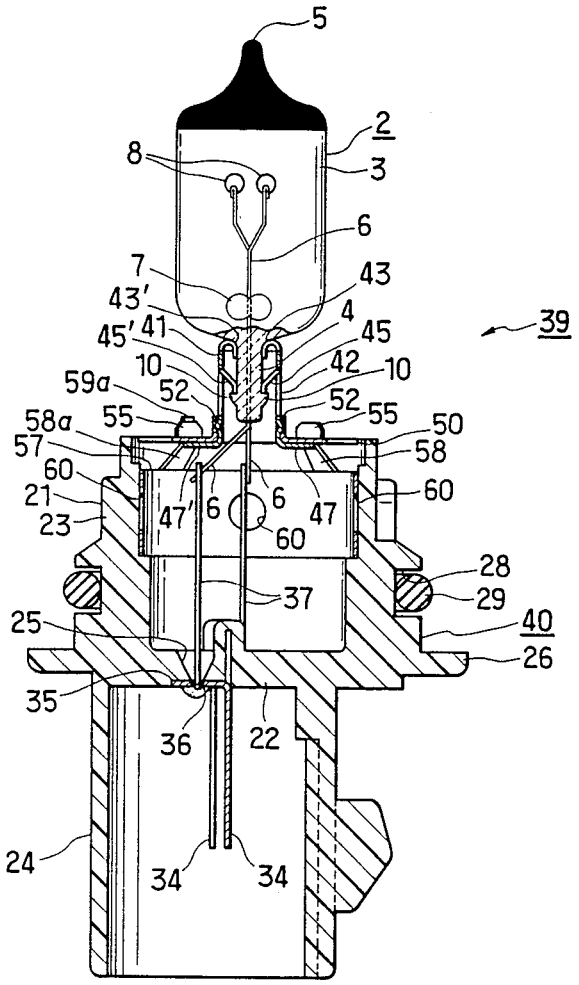
FIG. 9 is an axial section through the lamp assembly of FIG. 8.

FIGS. 7–9 illustrates a halogen cycle incandesent lamp assembly 39 constituting the third embodiment of my invention. The light bulb 2 of this lamp assembly 39 is of the same construction as that of the FIGS. 1–5 lamp assembly 1.

The bulb holder assembly for holding the light bulb 2 is generally labeled 40 in FIGS. 7–9. As in the FIGS. 1–5 embodiment, the bulb holder assembly 40 comprises a metal made holder band 41, a first metal made connector 50, the rigid plastic holder body 21 of the same construction as in the FIGS. 1–5 embodiment, and a second metal made connector 57.

Figure 10:
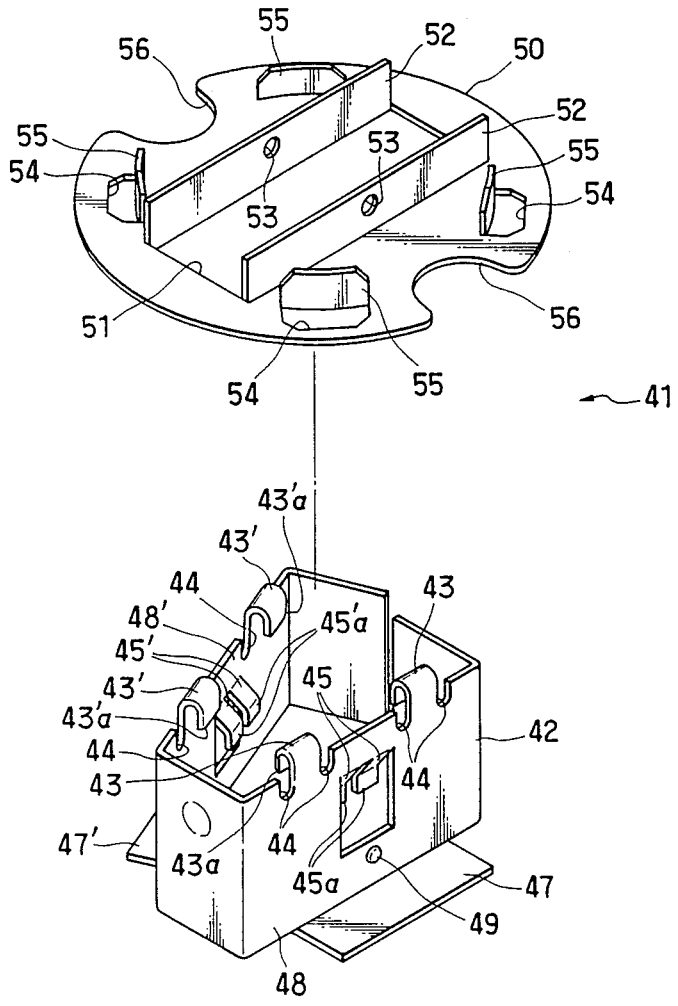
FIG. 10 is an enlarged, exploded perspective view of the holder band and the first connector used in the lamp assembly of FIG. 7.
Figure 11:
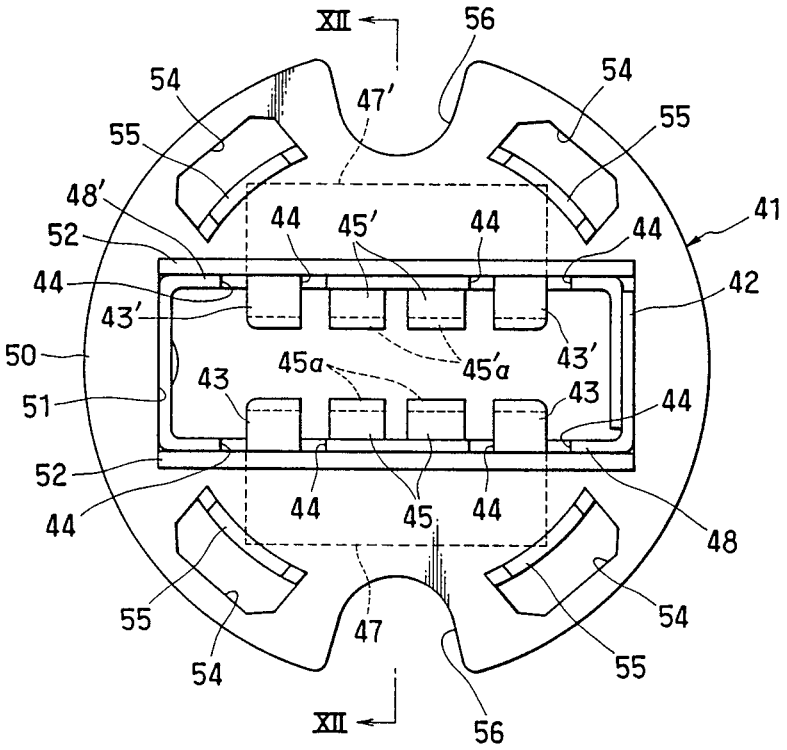
FIG. 11 is a still more enlarged plan view showing in assembled form the holder band and the first connector of FIG. 10.
Figure 12:
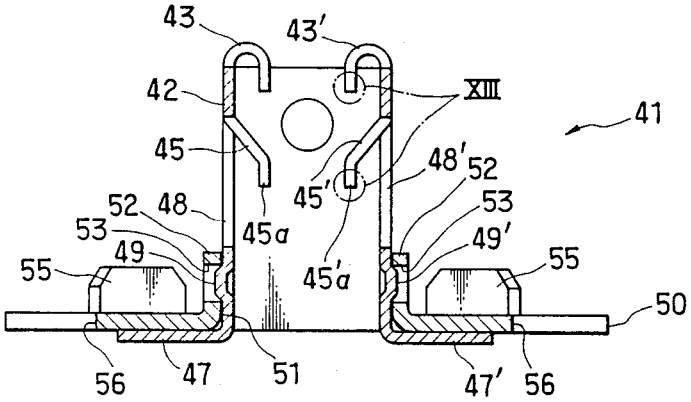
FIG. 12 is a section through the holder band and the first connector, taken along the line XII—XII in FIG. 11.

FIGS. 10–12 show the holder band 41 on an enlarged scale and in combination with the first connector 50. Fabricated from nickel silver or like resilient metal material, the holder band 41 has a portion 42 substantially in the shape of a tube of rectangular cross section, having two opposed pairs of U shaped bulb retainer lugs 43 and 43' formed on its front end. These lugs 43 and 43' are resiliently held against the opposite sides of the web portion of the bulb base 4 under their own bias. A pair of recesses 44 are formed in the front end of the holder band 41 on both sides of each bulb retainer lug 43 or 43'. These recesses 44 serve to increase the lengths of the bulb retainer lugs 43 and 43' and hence to augment their resiliency. As indicated in FIG. 10, those edges 43*a* and 43'*a* of the tips of the bulb retainer lugs 43 and 43' which contact the side rims 9 of the bulb base 4 are rounded so as not to ruin the side rims.

Two other opposed pairs of bulb retainer lugs 45 and 45' are formed rearwardly of the first recited pairs of lugs 43 and 43' so as to extend inwardly and rearwardly from the opposed walls of the holder band 41, terminating in bent tips 45*a* and 45'*a* laid parallel to each other. These tips of the retainer lugs 45 and 45' are also to be resiliently held against the opposite sides of the bulb base 4 in positive engagement with the ledges 10 formed thereon.

Figure 13:
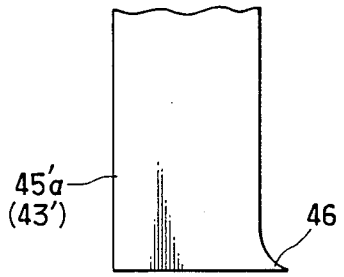
FIG. 13 is a greatly enlarged, fragmentary elevation of one of the bulb retainer lugs on the holder band of FIGS. 10–12, the illustrated part of the bulb retainer lugs being indicated by the numeral XIII in FIG. 12.

As shown on a greatly enlarged scale in FIG. 13, the above described bulb retainer lugs 43, 43', 45 and 45' will have burrs 46 that are created as the nickel silver sheet is punched to form such lugs. The directions of such punching, and the final orientations of the retainer lugs as these are bent as above specified, should be so determined that the burrs 46 may not come into contact with the bulb base 4.

The opposed pair of broader side 48 and 48' of the holder band 41 have a pair of flanges 47 and 47' bent outwardly and right angularly therefrom. These broader side 48 and 48' of the holder band 41 are further formed to include a pair of relatively small bosses 49 and 49' located adjacent the rear end of the holder band.

The first connector 50, which is made of a weldable metal such as stainless steel as is the first connector 16 of the foregoing embodiments, takes the form of a disc having formed centrally therein an opening 51 shaped and sized to relatively closely receive the tubular portion 42 of the holder band 41. A pair of support walls 52 extend forwardly and right angularly from the pair of opposite longer edges bounding the opening 51. Each support wall 52 has a hole 53 defined centrally therein for engagement with one of the bosses 49 and 49' on the holder band 41.

As clearly illustrated in FIG. 12, the tubular portion 42 of the holder band 41 is inserted in the opening 51 in the first connector 50 until the pair of flanges 47 and 47' of the holder band come to butt on the first connector. The pair of bosses 49 and 49' on the broader side walls 48 and 48' of the holder band 41 will become engaged in the holes 53 in the support walls 52 of the first connector 50 upon full insertion of the holder band tubular portion 42 in the first connector opening 51. Thus properly positioned one with respect to the other, the holder band 41 and first connector 50 may be integrally joined to each other as by spot welding. The two parts 41 and 50 will be easily and firmly welded together as the first connector 50 is made of a highly weldable metal such as stainless steel of the previously specified compositions.

FIGS. 10 and 11 best indicate a plurality of, four in this embodiment, apertures 54 formed in the first connector 50 at circumferential spacings therein by punching. As many connector lugs 55 are formed one adjacent each aperture 54 by forwardly bending the punched parts of the first connector 50.

This alternative embodiment further features a pair of approximately semicircular recesses 56 formed in diametrically opposite positions in the first connector 50. As will be understood from FIG. 8, these recesses 56 serve to provide openings for the escape of heat from within the holder body 21 in the use of the lamp assembly 39.

A consideration of FIG. 9 will reveal how the holder band 41 support the light bulb 2. The bulb base 4 is resiliently supported by the two front pairs of retainer lugs 43 and 43' and the two rear pairs of retainer lugs 45 and 45'. The front pairs of retainer lugs 43 and 43' are held against the rear end of the bulb envelope 3 and are closely caught between the pair of side rims 9 of the bulb base 4. As has been stated in connection with FIG. 10, these retainer lugs 43 and 43' have rounded edges 43*a* and 43'*a* in order to avoid marring the inside surfaces of the bulb base rims 9. Further, as the rear pairs of retainer lugs 45 and 45' are held against the bulb base 4, their tips 45*a* and 45'*a* make positive engagement with the ledges 10 on both sides of the flat bulb base. I have mentioned with reference to FIG. 13 that the retainer lugs 45 and 45' are so formed that the burrs 46 thereof do not make contact with the bulb base 4 in order to avoid damage thereto.

Thus, as in the foregoing embodiments, the light bulb 2 is supported by the holder band 41 against the possibility of displacement or detachment.

Figure 14:
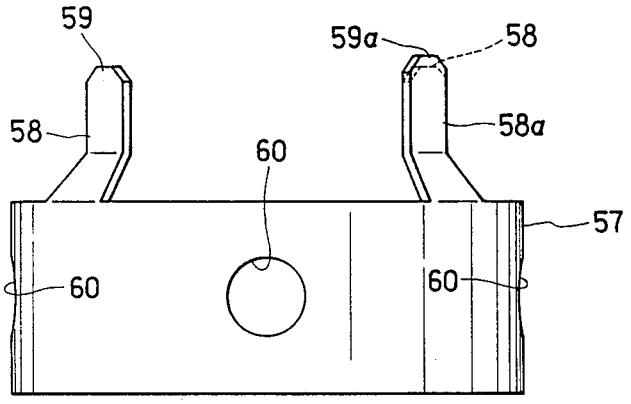
FIG. 14 is an enlarged elevation of the second connector used in the lamp assembly of FIGS. 1–9.

With particular reference to FIGS. 7 and 14 the second connector 57 is formed by winding a strip or band of stainless steel or like weldable metal into tubular form and by clinching its meeting ends. The second connector 57 can be of the same material as the first connector 50 as in the FIGS. 1–5 embodiment. Extending forwardly and inwardly from the front end of the second connector 57 are a plurality of, four in this embodiment, connector fingers 58 having tips 59 for engagement in the respective apertures 54 in the first connector 50. As will be noted from FIG. 14, one, designated 58*a*, of these connector fingers 58 is made longer than the other fingers in this lamp assembly 39 for a purpose yet to be described. A suitable number (e.g. three) of holes 60 are formed in the second connector 57 at circumferential spacings.

After mounting the second connector 57 in the front portion 23 of the holder body 21 as best seen in FIG. 9, the holder body may be heated as by high frequency induction heating. Being thermoplastic, the holder body 21 will then become plastic enough to partly flow into the holes 60 in the second connector 57 thereby locking the same in position within the holder body.

The lamp assembly 39 further comprises the three blade-like terminals 34 mounted within the rear portion 24 of the holder body 21, and the three wires or conductors 37 within the front portion 23 of the holder body. The conductors 37 extend through the taper holes 25 in the holder body partition 22 and have their rear ends engaged in the holes 36 in the mounting lugs 35 of the terminals 34. The rear ends of the conductors 37 are soldered to the mounting lugs 35.

For rigidly interconnecting the first and second connectors 50 and 57, the tips 59 of the fingers 58 on the second connector may first be inserted in the respective apertures 54 in the first connector. The longer one 58*a* of the fingers 58 will serve as a mark in inserting the finger tips 59 and 59*a* in the apertures 54 in the correct relative angular positions of the connectors 50 and 57. Then the connectors 50 and 57 may be manually turned relative to each other about the lamp axis until the bulb filaments 8 become correctly positioned with respect to the positioning recesses 27 in the holder body flange 26. Then the finger tips 59 and 59*a* of the connector fingers 58 and 58*a* may be plasma welded to the connector lugs 55 of the first connector 50. A grounding electrode may be held in contact with the longer connector finger 58*a* during such plasma welding. The first and second connectors 50 and 57 may be securely welded together as they are both made from a weldable metal such as the stainless steel of the previously specified compositions.

The leads 6 extending outwardly from the bulb base 4 may be conventionally joined to the conductors 37 as by soldering. I recommend soldering by high frequency induction heating.

Fourth Form

Figure 15:
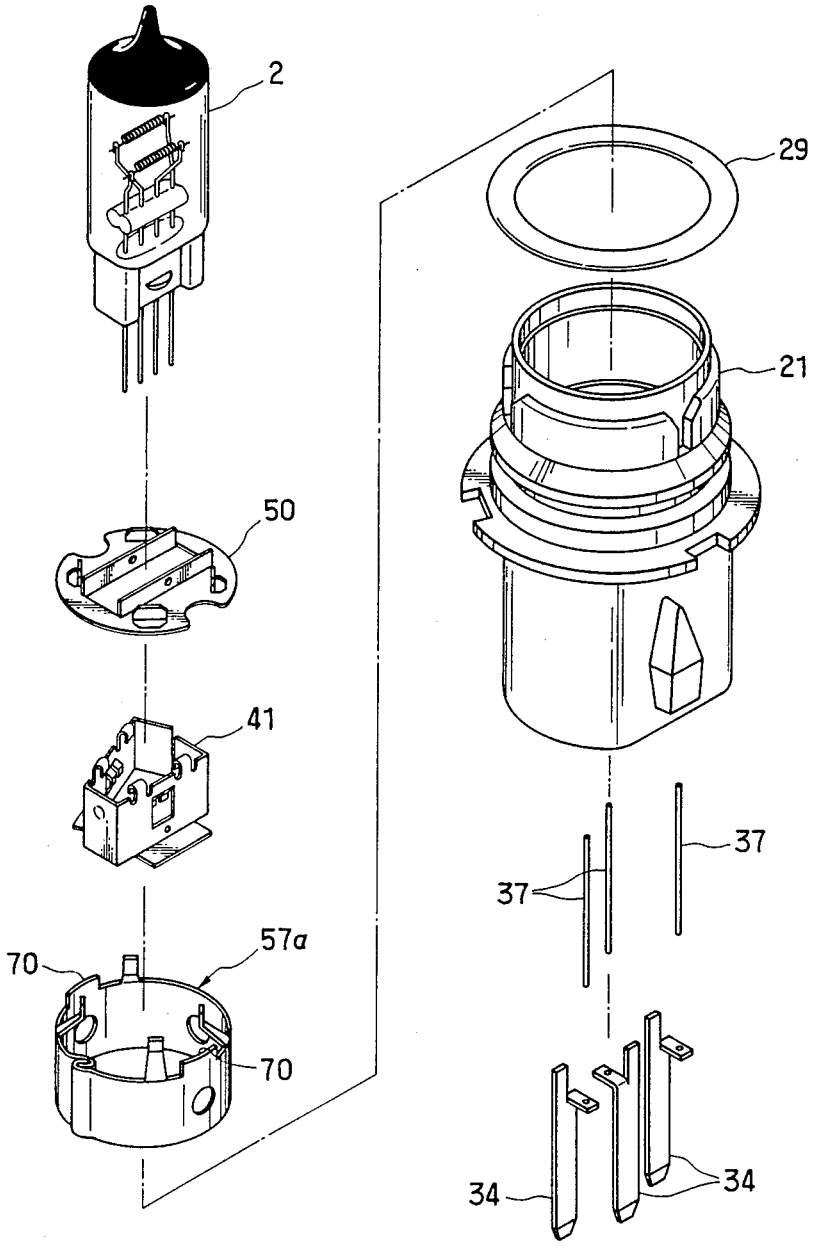
FIG. 15 is an exploded perspective view of an additional halogen cycle incandescent lamp assembly representing a slight modification of the FIGS. 7–14 embodiment.
Figure 16:
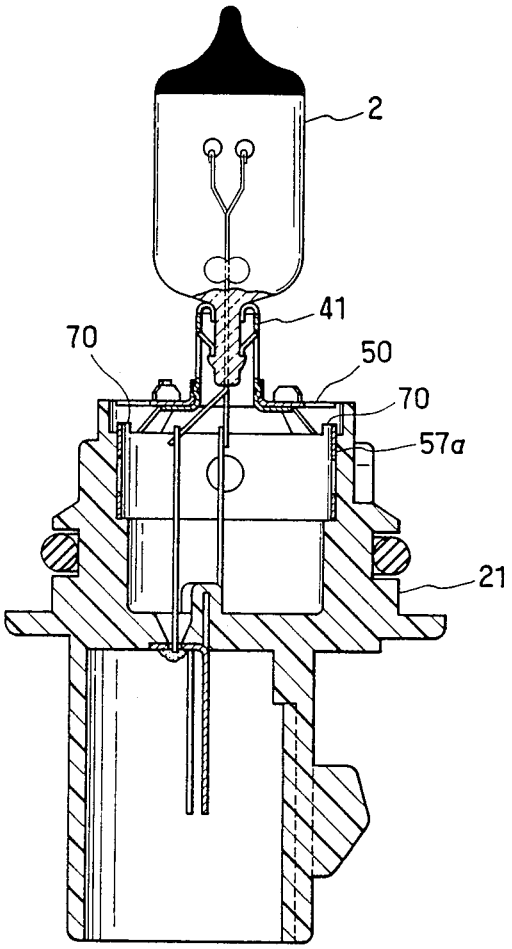
FIG. 16 is an axial section through the lamp assembly of FIG. 15.

FIGS. 15 and 16 illustrates a further preferred form of lamp assembly in accordance with my invention, which in fact is a slight modification of the FIGS. 7–14 lamp assembly 39. This modified lamp assembly features a second metal made connector 57*a* having a pair of forward extensions 70 formed in diametrically opposite positions on the front end of the second connector. The extensions 70 are intended to facilitate manipulation, either by hand or tool, of the second connector 57*a* in inserting the same into the holder body 21 during the assemblage of this lamp assembly. The other details of construction can be as previously set forth in connections with the FIGS. 7–14 lamp assembly 39. Of course, the second connector 30 of the FIGS. 1–6 lamp assembly 1 could be modified as taught by FIGS. 15 and 16.

Numerous modifications of the illustrated embodiments may be resorted to without departing from the scope of the invention.

I claim:

1. An electric lamp assembly for vehicular headlight and other lighting applications, comprising:

(a) a light bulb having a base;

(b) a holder band holding the light bulb by resiliently engaging the base thereof, the holder band being made from a first metal that is resilient enough to enable the holder band to firmly hold the light bulb;

(c) a first connector welded to the holder band, the first connector being made from a second metal that is weldable enough to permit the first connector to be firmly welded to the holder band;

(d) a holder body of substantially tubular shape molded from a plastic; and (e) a second connector of weldable material immovably engaged in the holder body and welded to the first connector in order to hold the light bulb in position on the holder body via the holder band and the first connector.

2. The electric lamp assembly of claim 1 wherein the first metal is nickel silver or brass.

3. The electric lamp assembly of claim 1 wherein the second metal is stainless steel.

4. The electric lamp assembly of claim 3 wherein the stainless steel is of the class consisting essentially of iron, chromium, and nickel.

5. The electric lamp assembly of claim 1 wherein the second connector is also made from the second metal.

6. An electric lamp assembly for vehicular headlight and other lighting applications, comprising:

(a) a light bulb having a substantially flat base;

(b) a holder band of substantially tubular shape encircling the base of the light bulb and integrally including bulb retainer means for resiliently engaging the base of the light bulb, the holder band including the bulb retainer means being made from a first metal that is resilient enough to enable the bulb retainer means to firmly engage the base of the light bulb;

(c) a first connector welded to the holder band, the first connector being made from a second metal that is weldable enough to permit the first connector to be easily and firmly welded to the holder band;

(d) a holder body of substantially tubular shape molded from a plastic; and (e) a second connector of substantially tubular shape and of weldable material immovably engaged in the holder body and welded to the first connector in order to hold the light bulb in position on the holder body via the holder band and the first connector.

7. The electric lamp assembly of claim 6 wherein the first connector is in the shape of a disc having an opening defined centrally therein to fit over the holder band.

8. The electric lamp assembly of claim 7 wherein the first connector has defined therein a plurality of spaced apart apertures with a connector lug formed adjacent each aperture, and wherein the second connector has a plurality of connector fingers extending from one end thereof and engaged in the respective apertures in the first connector, the connector fingers having tips welded to the connector lugs of the first connector.

9. The electric lamp assembly of claim 8 wherein one of the connector fingers of the second connector is longer than the other connector fingers.

10. The electric lamp assembly of claim 7 wherein the first connector closes one end of the holder body and is recessed to provide an opening for the escape of heat from within the holder body.

11. The electric lamp assembly of claim 7 wherein the first connector is formed to include a pair of opposed support walls on opposite sides of the central opening therein, the support walls being held against the holder band.

12. The electric lamp assembly of claim 11 wherein the holder band and the pair of support walls of the first connector interengageable means formed thereon for positioning the holder band and the first connector with respect to each other.

13. The electric lamp assembly of claim 6 wherein the holder body is formed to include a partition dividing the holder body into a first portion having the second connector engaged therein, and a second portion for accommodating terminals electrically connected to the light bulb.

14. The electric lamp assembly of claim 13 wherein the second portion of the holder body is partly filled with an adhesive for waterproofing the holder body and for securely retaining the terminals in position therein.

* * * * *